United States Patent [19]

Moore

[11] 4,310,059

[45] Jan. 12, 1982

[54] COMPOSITE HEAVY METAL DRILL COLLAR

[75] Inventor: Norman B. Moore, Salt Lake City, Utah

[73] Assignee: Christensen, Inc., Salt Lake City, Utah

[21] Appl. No.: 113,681

[22] Filed: Jan. 21, 1980

[51] Int. Cl.[3] ..... E21B 17/16; F16L 9/14

[52] U.S. Cl. ..... 175/320; 285/333; 285/381; 285/422

[58] Field of Search ..... 175/320; 285/381, 173, 285/55, 422, 333, 334; 138/143, 153

[56] References Cited

U.S. PATENT DOCUMENTS

| | | | |
|---|---|---|---|
| 2,564,670 | 8/1951 | Bratt | 285/381 X |
| 2,958,512 | 11/1960 | Humphrey | 175/320 X |
| 3,047,313 | 7/1962 | Bruce | 285/47 |
| 3,167,137 | 1/1965 | Humphrey | 175/320 |
| 3,542,404 | 11/1970 | Henry et al. | 285/381 X |
| 3,706,348 | 12/1972 | Murphey, Jr. | 175/320 |

FOREIGN PATENT DOCUMENTS

| | | | |
|---|---|---|---|
| 1518788 | 7/1978 | United Kingdom | 285/381 |

*Primary Examiner*—Thomas F. Callaghan

*Attorney, Agent, or Firm*—Bernard Kriegel; Philip Subkow

[57] ABSTRACT

A composite drill collar for drilling bore holes in earth formations including a structural steel outer jacket having a lower end secured to a lower coupling connectable to a drill bit and an upper end secured to an upper coupling connectable to an adjacent drill collar thereabove. An annular heavy metal core of depleted uranium or sintered tungsten is disposed in the jacket and is held in compression therein as by shrink fitting it to the jacket. The structural steel jacket has a heavy wall thickness to carry the bending, torsion, compression, tension and impact loads encountered in the drilling operation, so that such loads are not carried through the core, which has the purpose of increasing the density and mass of the composite drill collar, lessening considerably the tendency for a deviated well bore to be produced.

6 Claims, 3 Drawing Figures

COMPOSITE HEAVY METAL DRILL COLLAR

Figure 1:
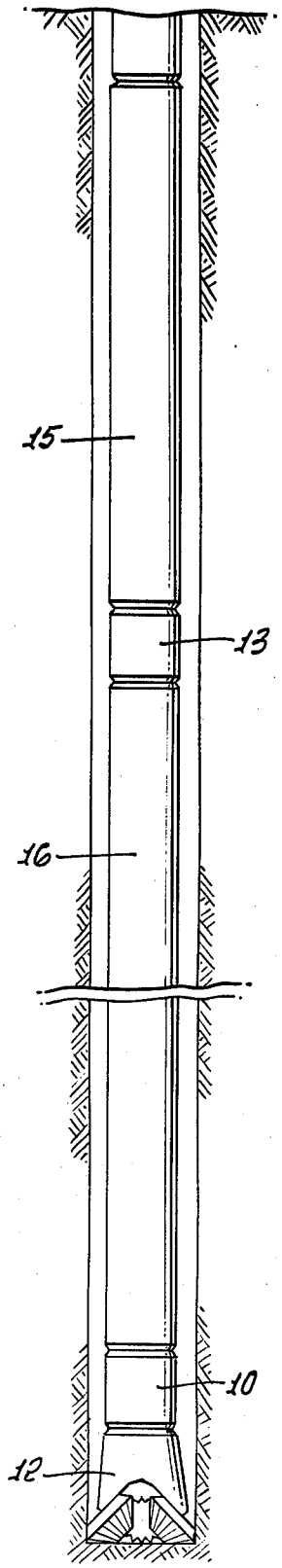

The present invention relates to subsurface apparatus for drilling oil, gas and similar well bores or bore holes in earth formations, and more particularly to heavy metal drill collars adapted to be incorporated in drill strings connected to drill bits.

Heavy metal drill collars that have an average density greatly exceeding that of steel have been proposed for incorporation in a drill pipe string to prevent the tendency of the drill bit to drill a bore hole deviating from a desired path. Such collars are disclosed in U.S. Pat. Nos. 2,958,512; 3,047,313; 3,167,137 and 3,706,348, all of which include an annular chamber within a steel outer jacket containing a metal having a density much greater than that of steel. In U.S. Pat. Nos. 2,958,512 and 3,167,137, the chambers are filled with lead or a lead alloy. Such metals have a number of disadvantages, including insufficient specific gravity greater than steel, relatively ready deformability under the impact loads to which the apparatus is subjected during the rotary drilling of the bore holes, a tendency to be displaced and pack into the threaded connections at the upper and lower ends of the outer jacket, and relatively short life.

In U.S. Pat. No. 3,047,313, the annular chamber is filled with lead, mercury, tungsten, osmium or uranium. If tungsten or uranium is used, such materials are brittle and will break off readily, particularly since they are subject to impact or shock loads encountered during the drilling operation. The life of the drill collar is relatively short, since it will fail from fatigue.

In U.S. Pat. Nos. 2,958,512, 3,047,313 and 3,167,137, the heavy metal in the steel shell is not held therein rigidly and does not contribute to the structural strength of the drill collar. The only function of the heavy metal is to add more weight to the composite drill collar.

In U.S. Pat. No. 3,706,348, a heavy metal structure has its lower end coupled to a connector secured to a drill bit and its upper end coupled to a connector secured to a drill collar thereabove. The drilling torque and drilling weight are transmitted from the upper connector directly through the heavy metal structure to the lower connector, which subjects the heavy metal to bending, torsion, compression, tension and impact loads. The heavy metal in this patent is stated to be extruded depleted uranium or sintered tungsten, which are brittle materials, and which will break off due to repeated impact loads to which the drill collar is subjected during the rotary drilling operation. A threaded connection, provided between the upper and lower connectors and the heavy metal structure, is a source of failure because of the brittle characteristics of the tungsten and uranium. The heavy metal structure disclosed in U.S. Pat. No. 3,706,348 is incapable of safely withstanding shock loads, resulting in relatively early failure of the weighted drill collar.

In accordance with the present invention, the composite drill collar consists of a thick-walled shell or jacket, such as a high strength steel member, enclosing a heavy metal tubular core, such as extruded depleted uranium or sintered tungsten, which is preloaded in compression within the jacket and against the inner wall of the jacket. Such compressed state not only causes the core and jacket to move together as a unit during the drilling of a bore hole, but increases the resistance of the unit to deflection. Moreover, it insures the retention of the compressed state of the core when the composite heavy metal drill collar is subject to temperature changes, such as encountered in geothermally heated formations. In the event the core is made of depleted uranium, it makes a close fit with the inner wall of the shell. The core expands more than the thick-walled shell, since the linear coefficient of thermal expansion of the core is much greater than that of the steel shell, the core bearing against the shell wall and being held under compression. Because the compressive strength of the core is greater than its tensile strength, the core will have less tendency to crack in compression, resulting in a much greater core and collar life.

The thick-walled steel outer jacket or shell is capable of transmitting substantially all of the bending, torsion, compression and impact loads that are imposed on the collar during the drilling operation. Substantially all of such loads are transmitted through the jacket, and not through the heavy metal core, which is made of relatively brittle material, and which would tend to break off and suffer early fatigue failure in the event that loads other than compressive loads were imposed upon it.

Accordingly, it is an object of the present invention to provide a composite heavy metal drill collar having a thick-walled shell or jacket and a heavy core, the heavy core being maintained in compression, and the thick-walled shell transmitting substantially all of the various loads imposed upon the drill collar.

Another object of the invention is to provide a composite heavy metal drill collar in which the heavy metal core is secured within a thick-walled jacket or shell under compression, and in which substantially none of the drilling torque and drilling weight, other than the weight of the core, is transmitted through the core to the drill bit secured to the lower end of the drill collar, the core remaining under compression and fixed with respect to the thick-walled shell or jacket, despite variations in the temperature of the well bore in which the drill collar is disposed.

A further object of the invention is to secure the heavy metal core under compression bearing against the thick-walled shell, by effecting a shrink fit between the core and the shell.

This invention possesses many other advantages, and has other objects which may be made more clearly apparent from a consideration of a specific form in which it may be embodied, this form being shown in the drawings accompanying and forming part of the present specification, It will now be described in detail, for the purpose of illustrating the general principles of the invention; but it is to be understood that such detailed description is not to be taken in a limiting sense.

Figure 2A:
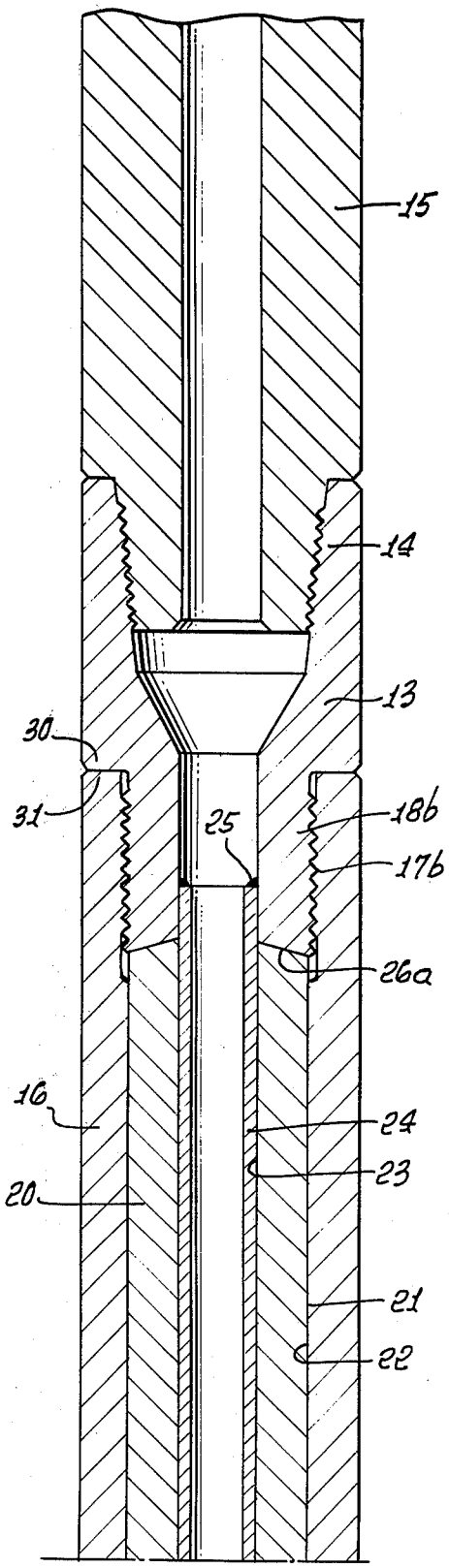
Figure 2B:
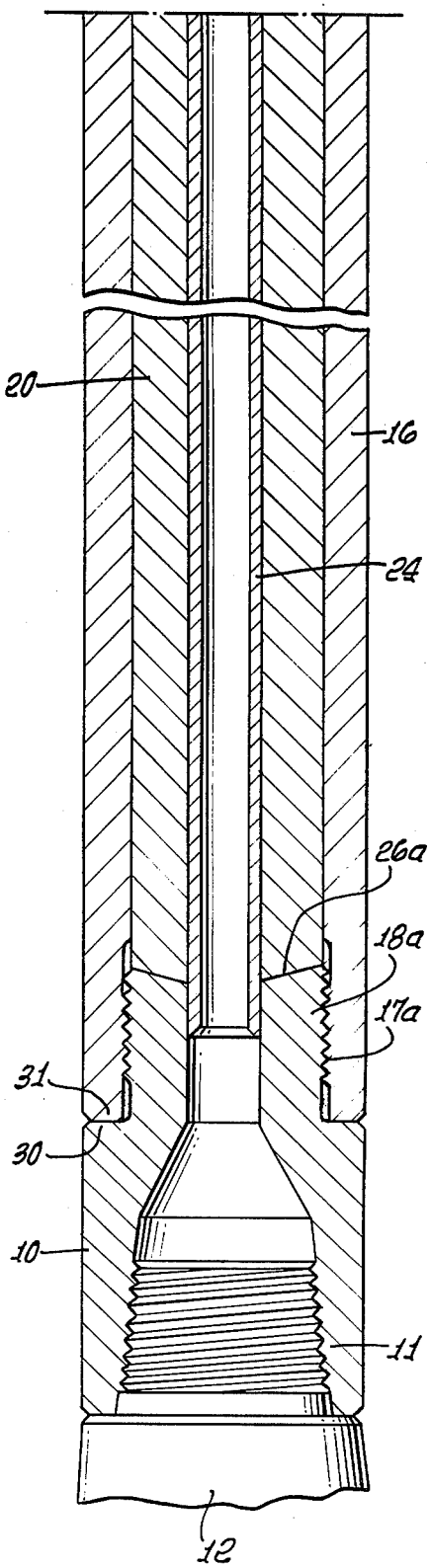

Referring to the drawings:

FIG. 1 is a side elevational view of a drill collar string embodying the invention and a drill bit attached thereto, all disposed in a well bore; and FIGS. 2*a* and 2*b* together constitute an enlarged longitudinal section through a portion of the drill collar string shown in FIG. 1, FIG. 2*b* being a lower continuation of FIG. 2*a*.

As illustrated in the drawings, a lower bit sub or connector 10 has a threaded box 11 for attachment to a suitable drill bit 12, an upper sub or connector 13 having a threaded box 14 for attachment to an adjacent upper drill collar 15. A thick-walled tubular jacket or shell 16, of a suitable length, is positioned between the two subs 10, 13, each end of the jacket being provided with a straight female thread 17*a*, 17*b* for threaded attachment to a companion pin 18*a*, 18*b* of the adjacent sub 10, 13. A heavy metal tubular core 20 is disposed within the jacket 16 and extends therein the full distance between the subs, the outer surface 21 of this core engaging the inner wall 22 of the jacket. The inner surface 23 of the core is disposed around an inner corrosion protection tube 24 which extends within the upper and lower subs and which is suitably secured to one of the subs, as by welding or brazing material 25.

The core 20 may be made in one piece or of a plurality of segments abutting one another. The tapered ends of the core are adapted to be engaged by the companion tapered inner ends 26*a* of the upper and lower subs 13, 10. The core is rigid and is preferably made of extruded depleted uranium to increase the density and weight of the composite steel and uranium structure, although the core may also be made of a heavy material, like rigid sintered tungsten composed of 95% tungsten and about 5% of a binder material of cobalt, nickel, copper and manganese. When depleted uranium is used as a core 20, it is placed under compression by shrink-fitting it to the steel jacket 26. One manner of accomplishing the shrink-fit is to make the external diameter 21 of the core slightly greater than the internal diameter 22 of the jacket wall, when both are at room temperature. Prior to assembling the core within the jacket, the latter is heated sufficiently to effect its thermal expansion and the core then slipped into the jacket to its final location, after which the jacket is allowed to cool and contract against the periphery 21 of the core, to provide a shrink-fit between these parts and place the core under compression. The end subs or connectors 13, 10 are then threaded into the steel jacket until a transverse shoulder 30 on each sub engages a companion transverse end 31 of the jacket.

The depleted uranium alloy has a specific gravity of about 18.4, as compared to a specific gravity of about 7.8 for the alloy steel, from which the outer jacket or shell is made.

As noted above, the core can be made of sintered tungsten, which has a specific gravity of about 17.0, as compared to a specific gravity of about 7.8 for steel. Both the sintered tungsten and the depleted uranium alloy have a specific gravity more than twice that of steel, enabling a much greater weight to be placed in the drilling string immediately above the drill bit, to utilize the pendulum effect of the concentrated heavier load adjacent the bit to prevent the latter from deviating from a desired drilling path in drilling the bore hole.

When a rigid tungsten alloy is used as the core material, its external diameter can also be made slightly greater than the internal diameter of the heavy wall steel jacket 16, which can be heated prior to insertion of the heavy metal core member or core segments, if more than a single member is used, into the steel jacket. The steel jacket temperature is raised to the desired degree to effect its expansion and enable the heavy metal core to be inserted into position, whereupon the steel jacket is allowed to cool and bring its inner wall 22 into firm gripping, frictional engagement with the outer perimeter 21 of the heavy metal core, creating a shrink-fit of the jacket against the segments, which will place the core in compression and insure its retention within the steel jacket. The bit sub 10 and the collar sub 13 are then threaded into the steel jacket until the shoulders 30 on the subs engage the respective ends 31 of the steel jacket.

The heavy metal drill collar 16, 20 is essentially different from other heavy collar concepts in that the jacket 16 itself has a thick wall and contains a heavy core 20, the jacket providing the structural integrity of the composite member 16, 20, while the heavy core provides the concentrated weight. As an example, a 9" O.D. jacket with a 6" I.D. inner wall receives a weighted core having a $2\frac{3}{4}$" diameter passage. Thus, the steel jacket has a $1\frac{1}{2}$" wall thickness, the core having a $1\frac{5}{8}$" wall thickness. The steel jacket carries the bending, torsion, compression, tension and impact loads transmitted between the upper collar 13 and the drill bit sub 10, the heavy metal core of depleted uranium or sintered tungsten providing an increase in the density and weight of the composite structure, without requiring the core to carry any of the structural loads. This combination greatly enhances the reliability and strength of the composite heavy metal drill collar.

In the event the composite collar is used in geothermally heated formations, known as "hot holes", the temperature of the collar will rise as it is lowered in the bore hole. In the case of depleted uranium, its linear coefficient of thermal expansion is about $9\times10^{-6}$ inches per inch per degree, whereas 4140 steel has a linear coefficient of thermal expansion of $5.6\times10^{-6}$ inches per inch per degree. Thus, with rise in temperature of the entire collar, and in view of the greater linear coefficient of thermal expansion of uranium, the compressive force imposed by the steel jacket on the depleted uranium core will actually increase. Although depleted uranium is a relatively brittle material, there will be lessened tendency for the increased compression imposed on the core to crack it, since such core is much stronger in compression to which it is subjected than the tensile stength of the core. Additionally, the jacket and core combination functions as a single unit, providing a greater resistance to deflection than the jacket alone. Accordingly, the composite collar is structurally superior to the threaded core disclosed in U.S. Pat. No. 3,706,348, referred to above.

In the event that the core material is sintered tungsten, which has been secured within the steel jacket by a shrink-fit, the use of the collar in geothermally heated formations will reduce the compressive force on the tungsten core, since the linear coefficient of thermal expansion of tungsten is less than that of steel. Nevertheless, the relative expansion of the steel jacket with respect to the tungsten core will be insufficient to release the core from its compressed state against the wall of the steel jacket. The sintered tungsten core will still be held in compression during the operating life of the drill collar.

I claim:

1. A composite drill collar adapted to form part of a drill pipe string used in drilling a bore hole in earth formations, comprising an elongate outer pipe member, upper connector means adapted to secure the upper end of said outer pipe member to an adjacent drill pipe member thereabove, lower connector means adapted to secure the lower end of said outer pipe member to a drill bit therebelow, a rigid elongate annular member in said outer pipe member having a specific gravity at least twice the specific gravity of said outer pipe member, said annular member being in a solid state when placed in said outer pipe member, means for preloading said annular member in radial compression by a temperature responsive shrink-fit of one of the members against the other of said members along substantially the entire length of said annular member within said outer pipe member before the composite drill collar is lowered in the bore hole, said outer pipe member having sufficient wall thickness whereby substantially all bending, torsion, compression, tension and impact loads are transmitted from the adjacent drill pipe member thereabove through said upper connector means to said outer pipe member and from said outer pipe member to said lower connector means and to the drill bit without being imposed on said annular member.

2. A composite drill collar as defined in claim 1; said outer pipe member being steel.

3. A composite drill collar as defined in claim 1; said annular member having a linear coefficient of thermal expansion greater than that of said outer pipe member.

4. A composite drill collar as defined in claim 1; said upper connector means being theadedly secured to said upper end of said outer pipe member, said lower connector means being threadedly secured to the lower end of said outer pipe member.

5. A composite drill collar as defined in claims 1, 2, or 4; said annular member being depleted uranium.

6. A composite drill collar as defined in claims 1, 2, or 4; said annular member being tungsten.

* * * * *